United States Patent [19]

Kulesza

[11] Patent Number: 4,508,517

[45] Date of Patent: Apr. 2, 1985

[54] PIVOTABLY LINKED TOY VEHICLES, ONE SELF-PROPELLED

[75] Inventor: Ralph J. Kulesza, Chicago, Ill.

[73] Assignee: Marvin Glass & Associates, Chicago, Ill.

[21] Appl. No.: 462,753

[22] Filed: Feb. 1, 1983

[51] Int. Cl.[3] ..... A63H 29/00

[52] U.S. Cl. ..... 446/464; 446/437; 446/451

[58] Field of Search ..... 46/201, 202, 206, 208, 46/209, 211, 213; 446/437, 462, 464, 431, 451

[56] References Cited

U.S. PATENT DOCUMENTS

| | | | |
|---|---|---|---|
| 2,587,052 | 2/1952 | Lohr | 46/213 |
| 2,649,805 | 8/1953 | Lohr | 46/211 X |
| 2,698,497 | 1/1955 | Müller | 46/211 X |
| 2,782,559 | 2/1957 | Strauss | 46/202 X |

FOREIGN PATENT DOCUMENTS

| | | | |
|---|---|---|---|
| 1914792 | 8/1970 | Fed. Rep. of Germany | 46/202 |
| 746262 | 3/1956 | United Kingdom | 46/202 |

*Primary Examiner*—F. Barry Shay
*Attorney, Agent, or Firm*—John S. Pacocha

[57] ABSTRACT

A toy vehicle device includes a pair of interconnected wheeled vehicle housings. The two housings are connected by a member for conjoint movement in parallel to one another and for swinging movement of one vehicle about the other. One of the vehicles includes a propulsion mechanism for propelling both vehicles over a supporting surface. One of the vehicles also includes a mechanism for causing one vehicle to swing about the other vehicle. In one embodiment of the present invention, the mechanism for swinging one vehicle about the other includes a rotatable bar mounted on a first vehicle to periodically contact the supporting surface and pivot the first vehicle with respect thereto so that the first vehicle makes a sharp U-turn. Thus, the second vehicle, connected to the first vehicle by the member, swings in a wider arc about the first vehicle when the first vehicle undergoes a sharp U-turn. This action simulates in an entertaining manner a chase sequence between two vehicles.

6 Claims, 6 Drawing Figures

PIVOTABLY LINKED TOY VEHICLES, ONE SELF-PROPELLED

BACKGROUND OF THE INVENTION

1. Field of the Invention

This invention relates generally to toy vehicles and particularly to those toy vehicles capable of simulating vehicular action sequences.

2. Background Art

A wide variety of toy vehicles, including those with self-propulsion mechanisms are known in the art, which are capable of simulating a variety of vehicular action sequences such as stunts, turning maneuvers, and crash sequences. While the variety of such vehicles is relatively extensive, there is a continuing demand for new and unique devices of this kind.

SUMMARY OF THE INVENTION

It is a primary object of the present invention to provide a toy vehicle device capable of simulating a two car chase sequence.

This and other objects of the present invention are achieved by a toy vehicle device including a pair of wheeled vehicle housings and means for connecting one of the housings to the other for spaced conjoint movement over a supporting surface. Means on one of the housings propels the housings over the supporting surface and means on one of the housings swings one housing about the other.

DESCRIPTION OF THE PREFERRED EMBODIMENT

Figure 1:
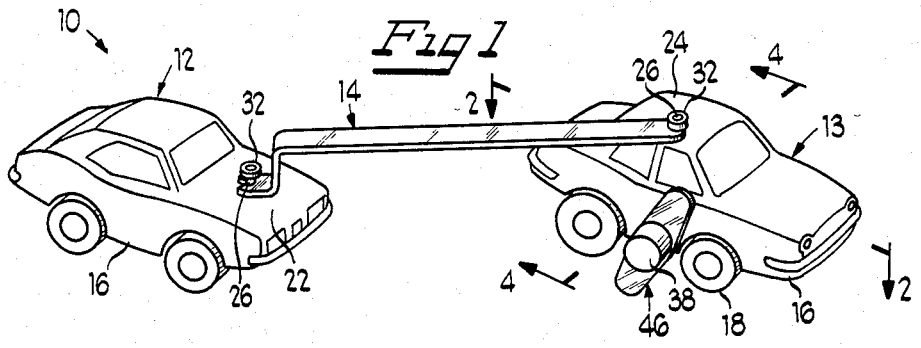
FIG. 1 is a perspective view of one embodiment of the present invention.

Referring to the drawing wherein like reference characters are used for like parts throughout the several views, the toy vehicle device 10, shown in FIG. 1, includes a pair of toy vehicles 12 and 13 connected by a member 14 for conjoint movement over a supporting surface. Each vehicle 12 or 13 includes a housing 16, conveniently formed in the shape of an automobile by conventional plastic molding techniques, supported atop the supporting surface by a set of wheels 18. The wheels 18 are connected together in pairs by axles such as 20*a* and 20*b*, rotatably mounted on propulsion mechanism 34. Conveniently, one set of wheels 18*a*, mounted on the rear of each vehicle, are of somewhat larger diameter than the set of wheels 18*b* mounted on the front of each vehicle.

As shown in FIG. 1, the connecting member 14 is advantageously an L-shaped, elongate rigid bar made of transparent material, connecting the front hood 22 of the vehicle 12 generally at its center to one side of the roof 24 of the vehicle 13. Conveniently, each vehicle housing 16 includes an upstanding pin 26 capable of being encircled by either the aperture 28 in one end of the member 14 or the slot 30 in the other end of the member 14. The connections between the member 14 and the pins 26 are maintained by rings 32 which fit over each pin 26. Thus, each vehicle 12 or 13 is capable of pivotal movement about a vertical axis with respect to the member 14 and with respect to the other vehicle 12 or 13. In addition, the spacing between the rings 32 and the vehicle housings 16 enables some pivotal movement of the member 14 about a horizontal axis with respect to each vehicle 12 or 13.

Figure 2:
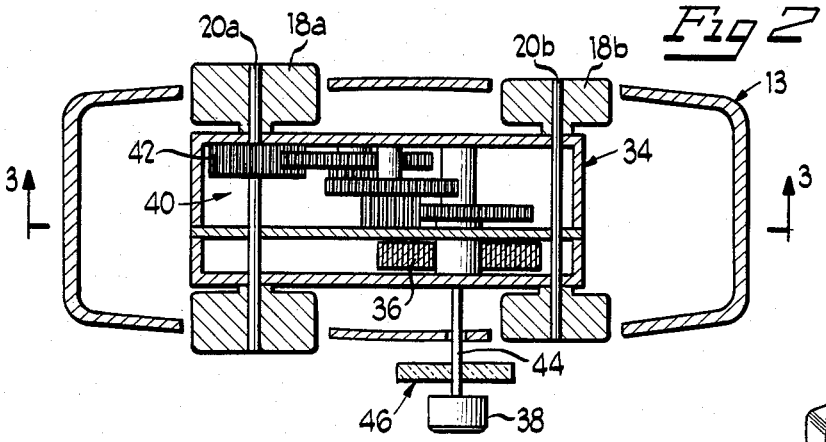
FIG. 2 is an enlarged, cross-sectional view taken generally along the line 2—2 in FIG. 1.
Figure 5:
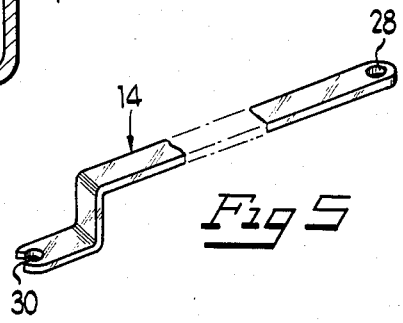
FIG. 5 is an enlarged, partial perspective view of the connecting bar shown in FIG. 1.
Figure 3:
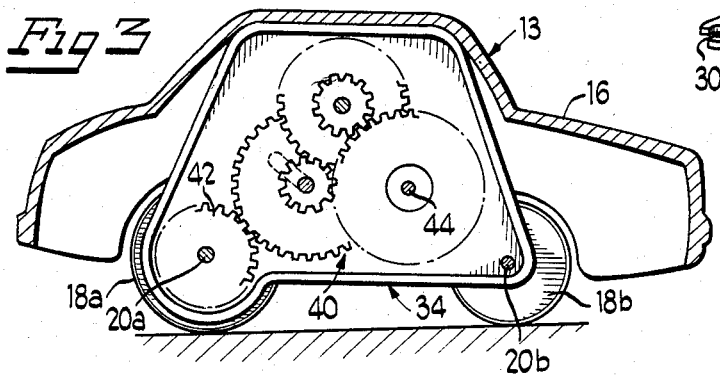
FIG. 3 is a cross-sectional view taken generally along the line 3—3 in FIG. 2.

As shown in FIG. 2, the vehicle 13 includes an internal propulsion mechanism 34, conveniently in the form of an enclosed wind-up motor, including a flat coiled spring 36. The mechanism 34 may be wound by a handle 38 which extends outwardly of the housing, connected to a speed increasing gear train 40. The gear train 40, in response to the unwinding of the coil spring 36, rotates, at an increased speed, a gear 42 fixed to the axle 20*a*. This results in a high speed rotation of the rear set of wheels 18*a*. The gear train 40 also controls the rate of energy transfer from the spring 36 to the wheels 18*a*.

Figure 4:
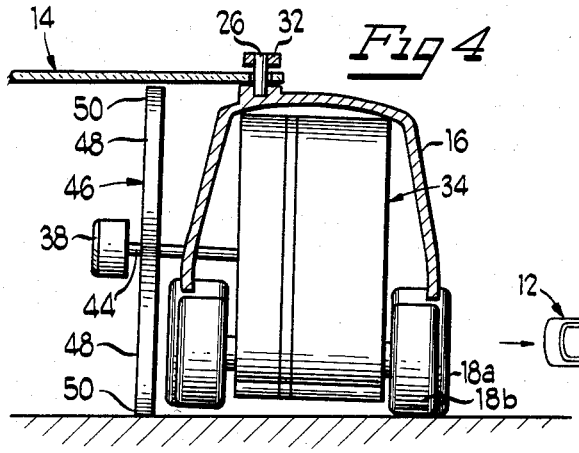
FIG. 4 is a cross-sectional view taken generally along the line 4—4 in FIG. 1.

Fixed to the axle 44 of the handle 38, a lever arm 46 is mounted for rotation with the gear train 40, on the outside of the housing 16. Thus, in response to the unwinding of the coiled spring 36, the centrally mounted lever arm 46 rotates around a generally horizontal axis arranged generally transverse to the length of the housing 16. The length of the two legs 48 of the arm 46 is such that the free end 50 of each leg 48 is capable of contacting the supporting surface and pivoting one side of the vehicle 13 about the other, as shown in FIG. 4. The play between the ring 32 and the vehicle housing 16 allows the vehicle 13 to pivot around its horizontal longitudinal axis to a slight degree with respect to the member 14.

Figure 6:
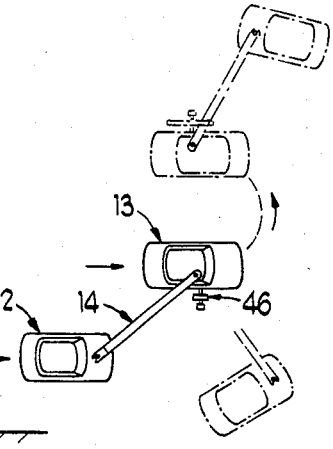
FIG. 6 is a reduced schematic view showing a chase action sequence that may be implemented by the embodiment shown in FIG. 1.

Thus, each time the free end 50 of one of the legs 48 contacts a supporting surface, the vehicle 13 is pivoted about one side. With the vehicle 13 moving along a supporting surface in a generally forward direction under the propulsion provided by the mechanism 34, this pivoting action causes the vehicle 13 to make a very sharp U-turn, as indicated in FIG. 6. The vehicle 12, which is conveniently without its own propulsion mechanism, normally trails behind the vehicle 13 as indicated in FIG. 6, when the vehicle 13 is moving in a forward direction under the power of a propulsion mechanism 34. When the vehicle 13 undergoes the sharp U-turn in response to the operation of the lever arm 46, the vehicle 12 swings about the vehicle 13 in an arc determined by the length of the member 14, as indicated in dotted lines in FIG. 6.

Thus, the toy vehicle device 10 is capable of simulating a chase sequence between two vehicles, creating the appearance that the vehicle 12 is chasing the vehicle 13. When the vehicle 13 makes a sharp turn, it appears that the vehicle 12 attempts to follow. The vehicle device 10 is capable of implementing a plurality of turns, followed and preceded by periods of forward progress, in a relatively automatic fashion. Thus, a rather extended and elaborate chase sequence may be implemented with the apparatus described.

The vehicle 12 may also be provided with its own propulsion mechanism 34 if desired. While the present invention has been illustrated as a four wheeled vehicle, it will be obvious to those skilled in the art that similar results could be accomplished using two wheeled and three wheeled vehicles. Similarly, it may be desirable under some circumstances to provide more than two vehicles and thus, the number of vehicles may be tied together using a plurality of connecting members 14. In addition, while the vehicle 13 is illustrated as having a mechanism which causes periodic turns of the vehicle 13 it would be possible to achieve a more limited chase sequence using a periodic braking unit so that when the vehicle 13 abruptly decelerates, the vehicle 12, connected by the member 14, swings about the vehicle 13. In addition, while the connecting member 14 is illustrated as a rigid device, it would be possible to use a flexible connection, such as a piece of string or a resilient strap to connect the two vehicles 12 and 13.

While the present invention has been described with respect to a single preferred embodiment, those skilled in the art will appreciate a number of modifications and variations therefrom, and it is intended to cover within the appended claims all such modifications as come within the true spirit and scope of the present invention.

What is claimed and desired to be secured by Letters Patent of the United States is:

1. A toy vehicle device comprising:

a pair of vehicles each supported on a surface by spaced apart rotatable wheels, and including a forward hood end, and a generally central roof that is higher than the hood end with respect to the supporting surface;

means including an L-shaped elongated bar connecting one side of the roof of one of the vehicles to generally the center of the front hood of the other of the vehicles for pivotal movement of each of the vehicles relative to the bar about a generally vertical axis while permitting some pivotal movement of the bar about a horizontal axis with respect to each of the vehicles;

means on one of the vehicles for propelling the vehicles over a supporting surface by driving at least one of the wheels of the one vehicle; and means mounted on said one vehicle for periodically contacting the supporting surface laterally spaced from the one driven wheel for causing the one vehicle to turn about the contact and swing the other vehicle about the one vehicle.

2. The device of claim 1 in which the bar is rigid.

3. The device of claim 1 in which the bar is transparent.

4. The device of claim 1 wherein said propelling means includes a wind-up motor.

5. The device of claim 1 wherein said contacting means includes a lever arm mounted on the side of said one vehicle for rotation with respect to said supporting surface and arranged to periodically contact the supporting surface.

6. The device of claim 5 wherein said propelling means includes a wind-up motor and said lever arm is mounted for rotation with said wind-up motor and arranged to periodically contact the supporting surface.

* * * * *

UNITED STATES PATENT AND TRADEMARK OFFICE

CERTIFICATE OF CORRECTION

PATENT NO. : 4,508,517

DATED : April 2, 1985

INVENTOR(S) : Ralph J. Kulesza

It is certified that error appears in the above-identified patent and that said Letters Patent is hereby corrected as shown below:

Change the schematic view of FIG. 6 from

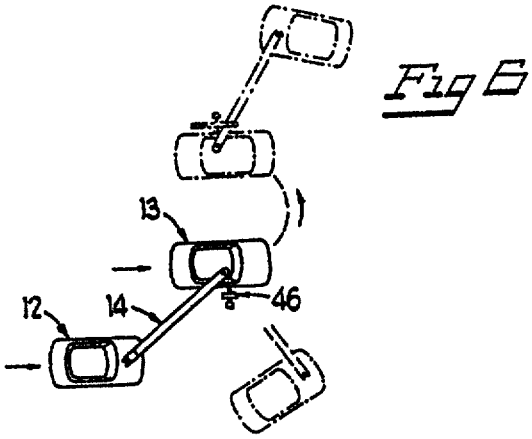

to

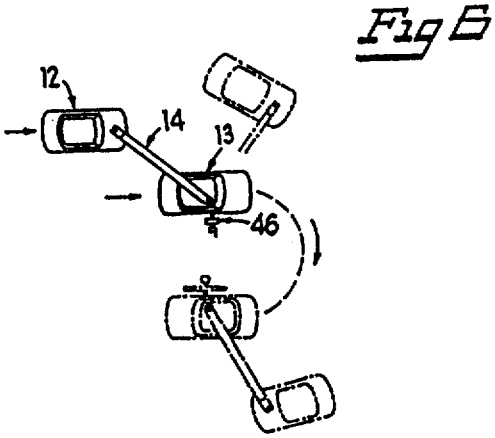

Signed and Sealed this

First Day of April 1986

[SEAL]

*Attest:*

DONALD J. QUIGG

*Attesting Officer*

*Commissioner of Patents and Trademarks*